US005271617A

United States Patent [19]

Gilford

[11] Patent Number: 5,271,617

[45] Date of Patent: Dec. 21, 1993

[54] BASKETBALL SHOT TRAINING DEVICE WITH RESILENT RESISTANCE

[76] Inventor: Luther G. Gilford, 24201 Rensselaer, Oak Park, Mich. 48237

[21] Appl. No.: 933,297

[22] Filed: Aug. 21, 1992

[51] Int. Cl.[5] ..... A63B 63/00; A63B 71/00; A63C 19/00

[52] U.S. Cl. ..... 273/1.5 A; 482/45; 482/47; 482/124

[58] Field of Search ..... 482/20, 44-47, 482/49, 50, 121, 124, 148; 273/1.5 A, 26 C; 602/20, 21; 73/379.01, 379.02

[56] References Cited

U.S. PATENT DOCUMENTS

| | | | |
|---|---|---|---|
| 4,310,154 | 1/1982 | Kauffman | 273/1.5 A |
| 4,383,685 | 5/1983 | Bishop | 273/1.5 A |
| 4,623,198 | 11/1986 | Juhl | 482/97 |
| 4,709,916 | 12/1987 | Clark | 482/47 |
| 4,807,609 | 2/1989 | Meals | 602/20 |
| 4,875,677 | 10/1989 | Tetreault | 273/26 C |
| 4,993,707 | 2/1991 | Schwartz | 273/1.5 A |
| 5,135,217 | 8/1992 | Swain | 482/124 |

OTHER PUBLICATIONS

Advertisement for Mini-Gym, Inc., titled "The Name of the Game is . . . 'Specificity'", dated May 1987.

*Primary Examiner*—Richard J. Apley
*Assistant Examiner*—Jeanne M. Mollo
*Attorney, Agent, or Firm*—John R. Benefiel

[57] ABSTRACT

A basketball training device is described for improving the shooting skills of the user including an elongated member adapted to be strapped to the user's forearm and a hemispherical finger and hand engagement element configured as a portion of a basketball facing the elongate member so as to be engagable with the user's fingers and hand. A resistance member pivotally mounts the hemispherical engagement element to resist movement from an inclined position to allow the user to flex the hand, fingers and wrist against the resistance in a manner closely simulating the execution of a basketball shot. An elbow rest is adjustably mounted at the opposite end of the elongate member.

9 Claims, 2 Drawing Sheets

BASKETBALL SHOT TRAINING DEVICE WITH RESILENT RESISTANCE

BACKGROUND OF THE INVENTION

This invention concerns training and exercising devices used as aids in increasing the shooting skill of a basketball player. Shooting skill improvement is usually achieved by sessions on the basketball court practicing the various shots, combined with general exercise, conditioning, and strengthening programs.

Heretofore it has been recognized that the execution of a physical skill is enhanced by the strengthening of the muscle groups involved. In recognition of this fact, exercising devices specifically directed to development of the hand and wrist muscle groups have been devised. However, heretofore these prior exercise devices have not sufficiently simulated the basketball shot motion to be of maximum effectiveness particularly in regards to the hand and finger muscles.

It would be useful if such exercising devices closely simulated the shot motion itself such as to contribute to the process of teaching the shot motion by repetition such as to provide an approximation of the benefit of actual practice shots.

Therefore it is an object of the present invention to provide a basketball training and exercising device which in use closely simulates the shot motion, such as to develop the precise muscle groups in the fingers, hand, wrist, and arm necessary to execute the basketball shot such as to cause development of those muscle groups and thereby enable improved basketball shooting skills.

It is a further object to provide a basketball training device which in use closely approximates the execution of the shot motion such that its use also contributes to the physical learning process.

SUMMARY OF THE INVENTION

These and other objects of the present invention are achieved by a basketball training device comprising an elongated member adapted to be strapped or otherwise secured to the forearm of the user, with a elbow anchoring rest mounted at one end of the elongated member, preferably adjustably mounted to be fit to the size of the individual user.

An inclined resistance member is pivotally mounted at the opposite end of the elongated forearm attaching member so as to be able to be swung towards and away from the side of the elongate member against which the user's forearm is secured.

A resilient resistance means resists away swinging movement of the resistance member on its pivotal mount in a direction so as to be more nearly parallel to the elongated member.

Attached to the free end of the resistance member, is a hand and finger engagement element, defining a generally spherical surface facing the hand at least approximating the external contour of a basketball.

To use, the forearm is strapped to the elongated member, with the elbow positioned in the elbow anchoring rest, with the hand bent at the wrist to engage the engagement element with the fingers and palm of his hand. The user pushes against the engagement surface, causing movement thereof forward and down, against the resistance provided by the device, exerting a strengthening effort with the wrist and fingers to closely approximate the shooting motion.

The resistance requires a substantial force to be overcome the resistance against swinging the ball.

This motion when repeated many times develops the precise muscle groups involved in executing the basketball shot, and at the same time in approximating the motion involved in making a shot, contributes to the physical learning process. The device allows the user to strengthen these muscle groups by a peak effort in excess of the effort required by actual shot.

The device allows convenient repetition of the motion a great number of times in a relatively short period and without the need to actually be present on a basketball court.

The device also tends to keep the elbow and forearm vertically aligned during execution of the shot motion, training the user to hold the elbow and forearm in vertical alignment during actual shooting. Maintaining this position is very beneficial to actually making a basketball shot. The device is thus also an aid in developing proper form.

DETAILED DESCRIPTION

In the following detailed description certain specific particular embodiment is described in accordance with the requirements of 35 USC 112. However, it is to be understood that the same is not intended to be limiting and should not be so construed inasmuch as the invention is capable of taking many forms within the scope of the appended claims.

Figure 1:
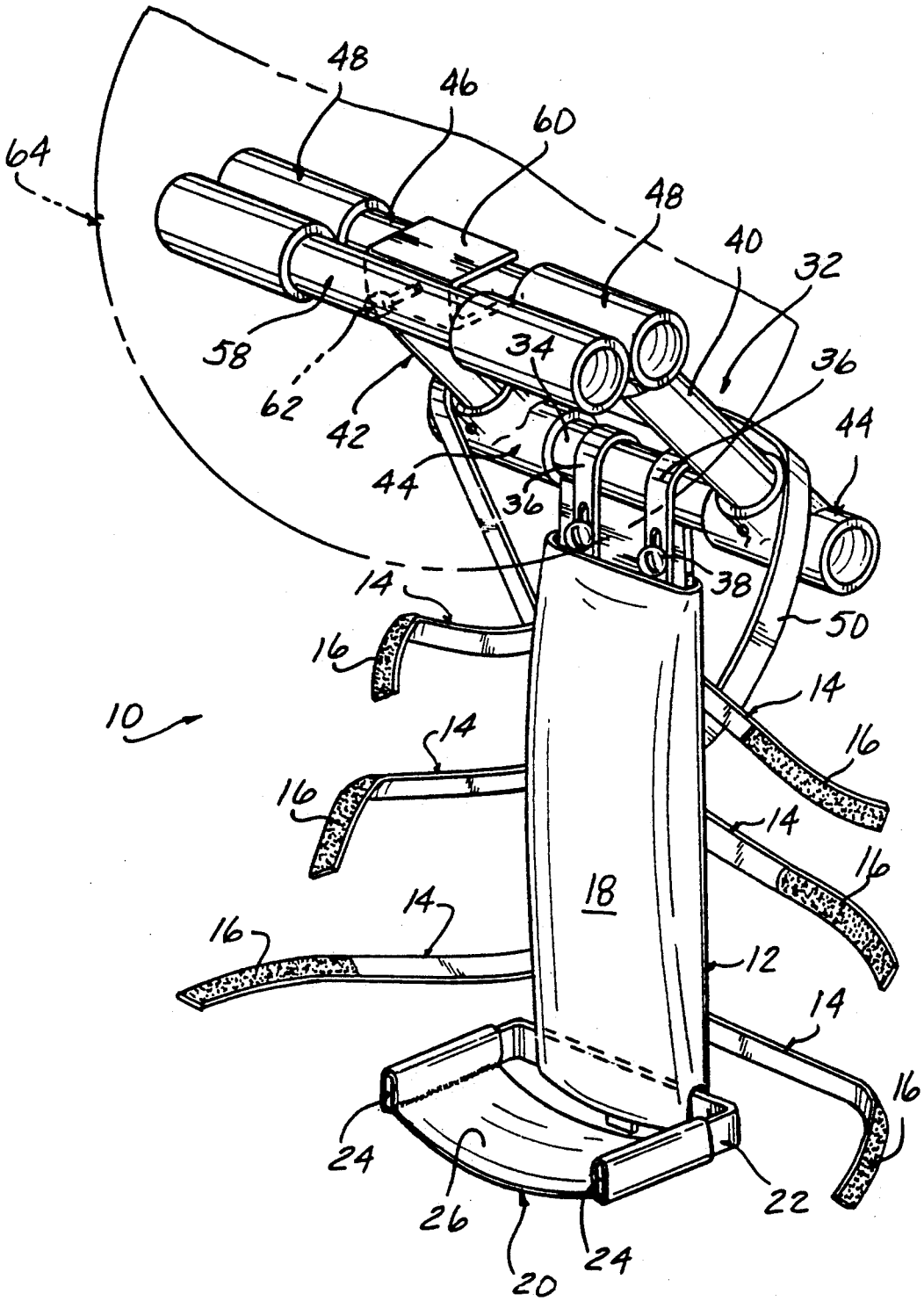
FIG. 1 is a perspective view of the basketball training device according to the present invention, depicting the engagement element in phantom to more clearly show the details of the other components of the device.
Figure 3:
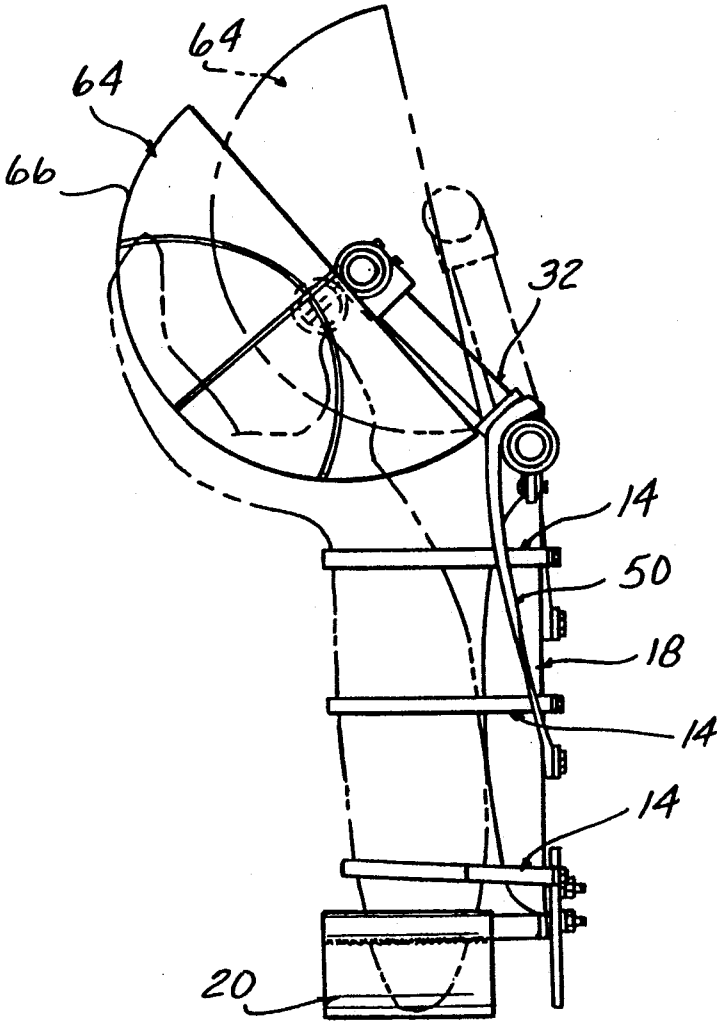
FIG. 3 is a side elevational device showing the position of the user's hand while having the device attached to the forearm, depicting in phantom the execution of the training motion.

Referring to FIG. 1, the basketball training device 10 according to the present invention includes an elongated member 12, which is of an approximate length corresponding to the human forearm, i.e., roughly 12 inches in length. The member 12 is equipped with a series of straps 14, which can be fastened together around the forearm of the user, as with Velcro (TM) patches 16 to the outer end of each strap 14.

The elongated member 12 is also preferably covered with a suitable padded covering layer 18, which allows a comfortable tight fit of the member 12 against the forearm of the user. Fastened at one end of the elongate member 12 is an elbow anchoring rest 20, which may take the form of a U-shaped frame 22. The frame 22 is defined in part by a pair of spaced apart arms 24, which are bridged by a suitable fabric strip 26, with loops at either side received over a respective arm 24.

The frame 22 is preferably adjustably mounted to the one end of the elongate member 12 by means of metal straps 28 having a series of holes therein so as to allow bolts 30 to be repositioned to increase the effective length of the elongate member 12 to be fitted to the forearm of larger individuals.

Pivotally mounted to the other end of the elongate member 12 is a swingable resistance member 32, here taking the form of a tubular framework, including an inner cross member 34 received within a pair of metal bands 36 fastened to the other end of the elongate member 12 with threaded fasteners 38.

The resistance member 32 is further comprised of a pair of tubular side members 40 and 42 extending from connecting fittings 44 to an outer cross member 46 attached by means of fittings 48.

Fittings 44 are rotatable on the inner cross member 34 and are guided by means of a pin 54 and slot 56 fixed to the fitting 44 and cross member 46 respectively.

Figure 2:
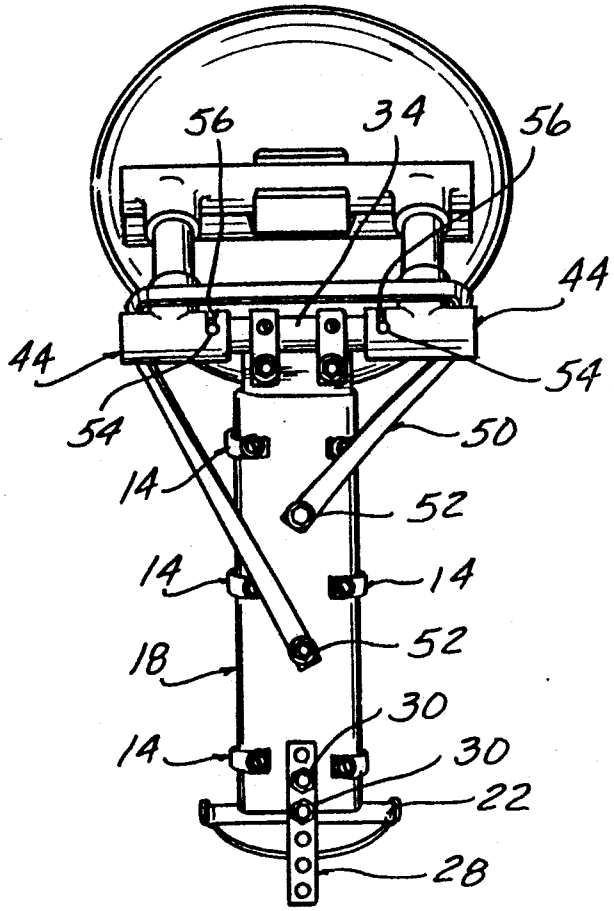
FIG. 2 is a reverse elevational view of the device shown in FIG. 1.

An elongated elastic band 50 passes around the resistance member 32 and is affixed to the rear face of the elongate member 12 with threaded fasteners 52 as best seen in FIG. 2. This generates a resilient resistance force acting to resist pivoting motion of the resistance member 32 from its maximum inclined position shown in FIG. 1, to a to a more nearly parallel relationship with the elongate member 12.

A second outer member 58 can be affixed to the first mentioned outer cross member 46, as by means of a bracket 60 and threaded fastener 62 to provide an anchoring for affixing thereto an hemispherical hand and finger engagement element 64 which is preferably of a size corresponding to a regulation basketball, and may be comprised of a portion of an actual basketball.

The hemispherical hand and finger engagement element 64 may be non rotatably anchored to the outer cross members 46 and 58 by means of a compound such as a urethane foam or the like, so as to dispose the hemispherical hand and finger engagement element 64 so that the convex surface faces back towards the upper part of the elongated member 12.

Thus, the user will fasten the straps 14 with the forearm extending along the upper padded surface 18 of the elongated member 12 with the elbow anchored against the rest 20 and the hand and spread fingers including the thumb pushing against the hemispheric outer surface 66 of the hemispherical hand and finger engagement element 64 to closely simulate the position of the arm, wrist, fingers and hand in the shooting position. By flexing the wrist, fingers and hand, the engagement element 64 will be moved away by swinging away of resistance member 32 to assume a less inclined position to a more nearly parallel position relationship with the elongate support member 12. This movement is against the resistance exerted by the elastic band 50.

This motion has been found to closely resemble the movement of the hand and wrist in executing a basketball shot. The fingers and hand as well as the wrist and forearm of the user are thus exercised in an almost identical fashion to that involved in an execution of an actual shot.

The resistance of the band 50 may be set to require a substantial effort which may be greater than that required in executing an actual shot such that the peak effort of these muscle groups is such as to cause a development of the strength beyond that which would be produced by merely practicing the basketball shot itself.

At the same time, the device is portable and compact and able to be employed in any environment to eliminate the need for practice sessions at a basketball court.

The device tends to cause the user to keep the elbow vertically aligned below the forearm during execution of the motion, which as mentioned above is helpful in making the shot. The device thus also assists in development of proper shooting form.

While a specific construction has been described in order to provide a description of a specific embodiment in accordance with the requirements of 35 USC 112 it will of course be understood by those skilled in the art that a great variation in the construction of this device is possible while still providing the same advantages and function thereof.

I claim:

1. A basketball training device comprising:

an elongate member;

forearm securement means for detachably securing said elongate member to the forearm of a user;

a resistance member pivotally mounted to one end of said elongate member so as to be swingable between a retracted position inclined from said elongate member to an extended position more nearly parallel thereto;

resilient means generating a resilient force resisting swinging of said resistance member away from said retracted position inclined with respect to said elongate member to said extended position more nearly parallel thereto;

a finger and hand engagement element fixed to said resistance member having a finger and hand engagement surface comprising a spherically curving surface non rotatably fixed relative said resistance member and facing towards said elongate member with said resistance member inclined with respect thereto, said spherically curved shape able to be engaged by all of the fingers including the thumb, and the palm of the hand of a person having a forearm secured to said elongate member with said resistance member in said retracted position, to enable pushing of said engagement element and resistance member against the force of said resilient means to provide resistance exercising of the wrist, forearm, fingers and hand as said resistance member is swung between said retracted and extended positions.

2. The basketball training device according to claim 1 wherein said engagement surface comprises a hemispherical surface thereof facing said elongate element and positioned to be engaged with all of the fingers including the thumb and the palm of the hand with said elongate member secured to the forearm during use thereof.

3. The basketball training device according to claim 1 further including an elbow rest affixed to an end of said elongate member opposite said end whereat said resistance member is pivotally mounted.

4. The basketball training device according to claim 3 wherein said elbow rest is adjustably mounted to said elongate member to enable adjustment in the lengthwise position thereof.

5. The basketball training device according to claim 1 wherein said elongate member comprises a padded surface on one side thereof against which a forearm may be secured.

6. The basketball training device according to claim 5 wherein said forearm securement means comprises a series of straps and means for securing such straps encircling the user's forearm pressed against said elongate member.

7. The basketball training device according to claim 2 wherein said finger and hand engagement element comprises a hemispherical member having a convex portion comprising said finger and hand engagement surface thereof facing toward said elongate member with said resistance member in an inclined position with respect thereto.

8. The basketball training device according to claim 1 wherein said resistance member comprises a frame including a pair of arms extending outwardly away from said elongate member and wherein said resistance means comprises a resilient strap passing around said arms and anchored at either end to said elongate member.

9. The basketball training device according to claim 2 wherein said engagement element comprises at least a portion of a standard basketball affixed to said resistance member.

* * * * *

UNITED STATES PATENT AND TRADEMARK OFFICE

CERTIFICATE OF CORRECTION

PATENT NO. : 5,271,617

DATED : December 21, 1993

INVENTOR(S) : Luther G. Gilford

It is certified that error appears in the above-identified patent and that said Letters Patent is hereby corrected as shown below:

On the title page, item [54], and in column 1, line 3, in the title, delete "RESILENT" and insert --RESILIENT--.

Signed and Sealed this

Thirty-first Day of May, 1994

*Attest:*

BRUCE LEHMAN

*Attesting Officer*

*Commissioner of Patents and Trademarks*